US005933099A

United States Patent [19]

Mahon

[11] Patent Number: 5,933,099

[45] Date of Patent: Aug. 3, 1999

[54] COLLISION AVOIDANCE SYSTEM

[76] Inventor: James Mahon, 2735 Taylor Ave., Ogden, Utah 84403

[21] Appl. No.: 08/802,071

[22] Filed: Feb. 19, 1997

[51] Int. Cl.[6] ..... G08G 5/04

[52] U.S. Cl. ..... 340/961; 340/945; 340/963; 701/14; 701/301

[58] Field of Search ..... 340/961, 973, 340/974, 975, 993, 301, 963, 945; 364/461, 439, 449.1; 342/29, 30, 31, 32, 36, 44, 455, 456; 701/9, 14, 301, 120, 207

[56] References Cited

U.S. PATENT DOCUMENTS

| | | | |
|---|---|---|---|
| 4,161,729 | 7/1979 | Schneider | 343/6.5 R |
| 4,197,538 | 4/1980 | Stocker | 343/6.5 L |
| 4,684,949 | 8/1987 | Kalafus | 342/41 |
| 4,695,013 | 9/1987 | Trampnau | 340/946 |
| 5,136,512 | 8/1992 | Le Borne | 340/970 |
| 5,179,377 | 1/1993 | Hancock | 340/961 |
| 5,185,606 | 2/1993 | Verbaarschot et al. | 340/961 |
| 5,208,591 | 5/1993 | Ybarra et al. | 340/961 |
| 5,227,786 | 7/1993 | Hancock | 340/961 |
| 5,313,201 | 5/1994 | Ryan | 340/961 |
| 5,450,329 | 9/1995 | Tanner | 340/973 |
| 5,506,590 | 4/1996 | Minter | 342/462 |
| 5,566,074 | 10/1996 | Hammer | 340/961 |
| 5,570,095 | 10/1996 | Drouilhet, Jr. et al. | 342/357 |

*Primary Examiner*—Jeffery A. Hofsass
*Assistant Examiner*—Van T. Trieu

[57] ABSTRACT

A collision avoidance system for a warning aircraft includes a transmitter and receiver for interrogating the transponder of a warned aircraft. A computer to be installed in the warning aircraft is programmed with the distances or rates of closure at which the warning aircraft and the warned aircraft constitute traffic for one another. When the computer has determined that the warning aircraft and a warned aircraft constitute traffic for one another, a warning system broadcast an appropriate vocal warning.

62 Claims, 1 Drawing Sheet

COLLISION AVOIDANCE SYSTEM

BACKGROUND OF THE INVENTION

1. Field of the Invention

This invention relates to a device for preventing collisions between moving vehicles, especially between flying vehicles.

2. Description of the Related Art

The substantial loss of lives and property which generally occurs when aircraft collide with one another underscores the critical need for air traffic control (ATC).

Air traffic control (ATC) is currently accomplished by two methods.

The traditional technique utilizes a human being who observes a two-dimensional presentation of aircraft positions which have been obtained through radar surveillance.

If the aircraft are equipped with an electronic receiving and transmitting device known as a transponder, additional coded data appear on the two-dimensional display, i.e., the radar screen, near the light indicating the horizontal position of the aircraft. Such additional data are the four-digit code transmitted by the transponder and an identification of the aircraft determined by a ground-based computer which has been informed of the four-digit code which a human air traffic controller has assigned to the aircraft. Furthermore, some transponders transmit the altitude of the aircraft so that this information is displayed on the radar screen.

The human controller observes and determines, usually from an illuminated boundary on the radar screen, which aircraft are within the human controller's geographical area of responsibility. Should any two such aircraft come within a predetermined distance (considering both horizontal and vertical separation) of one another, they are considered to constitute "traffic" for one another. The human controller will then speak by radio to the pilot of one or both aircraft. In this voice radio message, the pilot will be advised at least of the range (distance) and horizontal bearing from his aircraft to the other aircraft; often, when such information is available, the pilot will also be told the altitude of the other aircraft.

It then becomes the pilot's responsibility vocally to acknowledge receipt of the voice radio message from the human air traffic controller; to attempt to make visual contact with the other aircraft, i.e., the traffic; to advise the human controller of the pilot's success in so doing; and, if necessary, to maneuver the pilot's aircraft to avoid a collision with the other aircraft.

The second method of air traffic control involves the utilization of collision avoidance systems located aboard aircraft and often also employing ground-based components.

The commercially pre-eminent version of collision avoidance systems is known as the Traffic alert and Collision Avoidance System (TCAS) and is described in U.S. Pat. No. 5,248,968:

"After two decades of development by the Federal Aviation Administration (FAA) and private contractors, TCAS has matured to a level where United States public law now requires that a TCAS be installed on commercial airplanes with more than thirty seats, starting in December of 1990."

"A TCAS-equipped airplane is surrounded by TCAS-protected airspace whose physical dimensions vary as a function of altitude and closure rate, i.e., the rate at which other airplanes are approaching the TCAS-equipped airplane. Being a time-based avionic system, TCAS continuously estimates and updates the flight paths of other airplanes through the interrogation of, and replies from, airborne radar beacon transponders located onboard the other airplanes. An airplane whose estimated flight path is projected to penetrate the TCAS-protected airspace is considered a collision threat (intruder) and annunciated to the flight crew of the TCAS-equipped airplane."

"TCAS-protected airspace can be divided into a caution area and a warning area, based on the estimated time to the Closest Point of Approach (CPA). About 40–45 seconds prior to CPA an intruder penetrates the caution area and causes the annunciation of a Traffic Advisory (TA). If the intruder continues to come closer to the TCAS-equipped airplane, at about 20–25 seconds to CPA, the intruder reaches the warning area, resulting in the annunciation of a Resolution Advisory (RA). Both TAs and RAs are constantly updated and, therefore, provide real time position and advisory information."

"TAs and RAs are annunciated both visually and aurally. The aural portion consists of voice messages. The visual portion of TA and RA annunciators includes a traffic display in the horizontal plane and, for RA annunciators, a resolution display in the vertical plane."

Unfortunately, TCAS necessitates placement on the aircraft of equipment that is too large, too heavy, and too expensive for the relatively small aircraft commonly used in general (non-airline) aviation.

Even smaller than the aircraft traditionally associated with general aviation are the unmanned [terminology which has been established by the military and is used herein for consistency and clarity with previous publications, although the term pilotless would be more politically correct] aerial vehicles (UAV's) which the military has been employing with increased frequency since Operation Desert Storm to gather militarily significant data in the vicinity of an actual or potential battlefield without endangering a pilot and while presenting a smaller target for the enemy than does a traditional piloted military aircraft.

Just as the small general aviation aircraft create a potential hazard for one another, the UAV poses a significant potential hazard for the piloted military aircraft which necessarily must utilize the same airspace over a battlefield. Furthermore, the pilot may either be unaware of the potential presence of a UAV or may know only generally where one or more Equip may be encountered.

At least five patents cover collision avoidance systems or methods which depend upon the receipt of a transponder signal emitted by other aircraft. Transponders emit signals when they are interrogated by radar, specifically a secondary surveillance radar (SSR). None of these patents indicate whether the interrogating radar is airborne or ground-based, but none states that the interrogating radar is aboard the aircraft with the collision avoidance system.

U.S. Pat. No. 4,782,450 claims a method and device employing waves from a radar having a rotating beam and replies from a ground-based transponder to determine, through mathematical algorithms, the position of an aircraft equipped with special equipment and then utilizing a similar technique with the transponder replies from other aircraft to determine the positions of such other aircraft. The position of the ground-based transponder and of the radar must, according to lines 65 and 66 in column 8 of the patent, be stored in advance within the memory of the special equipment. This strongly suggests that the secondary surveillance radar will be on the ground.

The method and system of U.S. Pat. No. 5,075,694 utilize a direction-finding antenna to determine the direction of the interrogating source from the aircraft with the special equipment and, also, to determine the direction of another aircraft emitting a transponder reply. Additional techniques are then employed to determine the distance of the other aircraft from the specially equipped aircraft. But this method requires at least one "rotating interrogation signal source." The patent states, on lines 51 through 53 of column 4, that the system is designed to operate "in an environment having at least one rotating interrogation signal source (an SSR radar in the preferred embodiment)" and, on lines 5 through 7 of column 6, that "[i]nformation" concerning each SSR signal source is acquired from an SSR database, suggesting that the secondary surveillance radar is ground based.

The system of U.S. Pat. No. 5,196,856 utilizes and improved method to determine the proximity of other transponder-equipped aircraft to a specially equipped aircraft based upon the time of arrival of transponder replies and the beam from the secondary surveillance radar interrogating such transponders. The patent, on lines 45 through 47 of column 12, indicates that the radar is ground-based by explaining that the radar is either "a rapidly rotating airport radar or a slowly rotating en route radar."

The pilot warning apparatus of U.S. Pat. No. 5,223,847 uses a directional antenna system on an aircraft for receiving transponder replies from other aircraft to determine bearing, a comparison of data from transponder Mode C (containing encoded data describing the altitude of the transponder-equipped other aircraft) replies with the altitude of the aircraft having the pilot warning apparatus, and a comparison of with prior received signals to determine whether the other aircraft and the aircraft with the pilot warning apparatus are coming closer to one another. In lines 34 through 39 of column 4, the patent indicates that the interrogating radar is ground based: "It is another object to provide a system for detecting potential midair collision threats from other aircraft without having to generate radio signals other than those that are already being generated by the equipment in the other aircraft in response to ground ATC [air traffic control] interrogation."

Method claims in U.S. Pat. No. 5,157,615 determine a threat to a specially equipped aircraft by receiving replies from another aircraft with a transponder, learning the difference in altitude from the Mode C reply of the other aircraft and the altimeter of the specially equipped aircraft, and determining any closing trend from the strength of successive transponder replies. Although the patent does not state the origin of the interrogating signal, there is a strong inference that such interrogating signal originates away from the specially equipped aircraft because the patent, on lines 18 through 20 of column 37, describes the device employing the method as "a passive device performing effective proximity warning and collision avoidance functions" and, on lines 25 through 28 of column 37, asserts, "Notwithstanding its passive nature, . . . [such device] monitors traffic in the vicinity of the host based on transponder relies [sic] to SSR interrogations."

A direction-finding antenna system for receiving transponder replies from another aircraft accurately to determine the bearing of such other aircraft from the aircraft equipped with the direction-finding antenna system. The source of the interrogating signal is not identified.

None of the collision avoidance or warning systems discussed above, however, provide any information other than to the pilot of the aircraft equipped with the technology described in the patent. Protection of such other aircraft results, therefore, only indirectly from actions taken by the pilot of the aircraft equipped with the patented technology.

Moreover, to minimize the possibility of its being detected by the enemy, a UAV intentionally flies behind hills and in other locations that are inaccessible to coverage by air traffic control radar based either on the ground or in other aircraft, such as Airborne Warning and Command Systems (AWACS) aircraft. And general aviation aircraft without jet engines or turbocharged engines must, because of their somewhat limited service ceilings, when flying over mountains, fly so close to such mountains, that such general aviation aircraft are below the beams of air traffic control radar. Therefore, any collision avoidance system relying on interrogating radar that is not aboard the aircraft with the collision avoidance system would frequently be ineffective for such UAV's and general aviation aircraft.

The interrogating signal for the collision avoidance device of U.S. Pat. No. 4,161,729 emits its own interrogating signal. This signal is, however, detected only by other aircraft equipped with a similar collision avoidance device. The devices detect and compare Mode C altitude information from the transponder on both their own aircraft and that on the replying aircraft. The time to receive a return signal is detected; and if the other aircraft is within a given vertical distance, within a specified horizontal range, and approaching closer to the first aircraft, the collision avoidance device in each aircraft will alert the pilot of that aircraft.

Similarly, to work with another aircraft, the traffic monitoring device of U.S. Pat. No. 4,197,538 must be installed in both aircraft. The traffic monitoring device broadcasts, in code, the position and altitude of the aircraft in which it is installed. The identical device of the other craft then can display the position and altitude of the first aircraft and vice-versa. Unfortunately, not only must both aircraft be equipped with the traffic monitoring device, but broadcasting the position of one's aircraft may be extremely imprudent in a combat situation.

Identical disadvantages exist for the collision avoidance system of U.S. Pat. No. 5,153,836. The device of this system determines the position of the aircraft in which it has been installed, for example, by using GPS (Global Positioning System) or LORAN (Long Range Navigation) and then, just as did the traffic monitoring device of U.S. Pat. No. 4,197,538, broadcasts such position in a coded form which can be received and translated only by aircraft equipped with such a device. Of course, any aircraft that is equipped with this device will be able to have such device display the position of all other aircraft within range that are so equipped.

Finally, the anti-collision device of U.S. Pat. No. 4,104,638, when installed aboard an aircraft, provides information to other aircraft as long as such other aircraft have standard radio receivers and automatic direction finders (ADF's). The anti-collision device transmits tones. The ADF on a receiving aircraft then shows the bearing from the receiving aircraft to the aircraft with the anti-collision device. Proximity of the aircraft with the anti-collision device to the receiving aircraft can be inferred either from the rate of change of the ADF display or from the strength of the signal. Of course, to have any degree of precision, the measurement and comparison of signal strength would have to be accomplished by equipment that is not standard aboard an aircraft. Moreover, the aircraft with the anti-collision device obtains no information about other aircraft; and other aircraft do not learn the altitude of the aircraft with the anti-collision device.

SUMMARY OF THE INVENTION

The Collision Avoidance System of the present invention relies on no external interrogating source, which could be blocked by terrain.

Furthermore, this Collision Avoidance System provides a warning to other aircraft which have only avionics which is standard for general aviation aircraft (and, of course, for military aircraft). The warned aircraft will be equipped with a transponder (preferably a transponder the altitude of which transponder is included within the information contained in the signal transmitted by that transponder), an automatic direction finder (ADF), a radio voice receiver, and a speaker or an earphone.

Additionally, the warning is given in the form to which pilots have become accustomed for traffic advisories from the air traffic control (ATC) system of the Federal Aviation Administration (FAA), i.e., vocally.

No intervention is, moreover, required by equipment not aboard the warning aircraft and the warned aircraft or by any human being other than the pilot of the warned aircraft.

And the Collision Avoidance System for Aircraft which constitutes the present invention is physically small, lightweight, and relatively inexpensive.

DESCRIPTION OF THE PREFERRED EMBODIMENT

Figure 1:
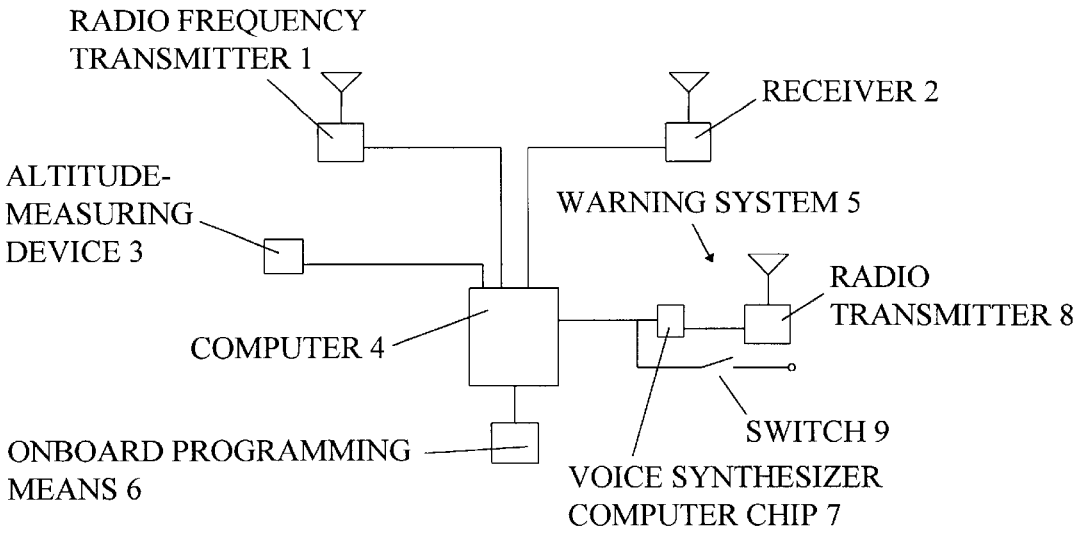
FIG. 1 illustrates the basic Collision Avoidance System of the present invention.

The Collision Avoidance Device, which is to be installed in the warning aircraft, employs the type of radio frequency transmitter 1 and receiver 2 which are well known in the art for interrogating the transponder in the warned aircraft; preferably an altitude-measuring device 3 capable of generating an electronic signal corresponding to the altitude of the warning aircraft; a computer 4, having (a) memory circuitry into which can be programmed the generally horizontal - - - and, preferably, the vertical - - - distance or the rate of closure at which the warning aircraft and the warned aircraft will be so close or approaching one another so rapidly as to constitute "traffic" for one another and (b) logic circuitry for determining time differentials, for calculating the generally horizontal distance between the warning aircraft and the warned aircraft by using the difference in time between the sending of the interrogation by the warning aircraft and the receipt of the answering data from the transponder of the warned aircraft, for calculating the vertical distance between the warning aircraft and the warned aircraft by using the electronic signal corresponding to the altitude of the warning aircraft together with the answering data from a transponder the altitude of which transponder is included within the information contained in the signal transmitted by that transponder in the warned aircraft, and for utilizing the data in the computer memory together with the preceding calculations to determine whether the warning aircraft and the warned aircraft constitute "traffic" for one another and - - - if so - - - to activate a warning system 5 if the two aircraft do constitute "traffic" for one another; optionally, an onboard programming means 6 such as a dial, keyboard, or touch-sensitive display screen; and the warning system 5. The warning system 5 will preferably be composed of a voice synthesizer computer chip 7 which the logic circuitry of the computer 4 can direct to send an appropriate vocal warning through a radio transmitter 8. Optionally, the warning system 5 will contain a switch 9 which will be directed by the computer 4 to activate the hazard warning lights of the warning aircraft.

The interrogating transmitter 1, the interrogating receiver 2, the altitude-measuring device 3, the warning system 5, and the onboard programming means 6 all communicate with the computer 4, preferably electrically, as illustrated in FIG. 1.

When the interrogating transmitter 1 and the interrogating receiver 2 have interrogated another aircraft, designated the warned aircraft, and received a signal in response, the computer 4 will utilize such signal, as described above, to determine the generally horizontally distance between the warned aircraft and the warning aircraft. If the warning aircraft has an altitude-measuring device 3 and the warned aircraft has a transponder the altitude of which transponder is included within the information contained in the signal transmitted by that transponder, the computer 4 will, as also described above, calculate the vertical distance between the warned aircraft and the warning aircraft. The rates of horizontal and vertical closure between the warned aircraft and the warning aircraft can additionally be calculated by the computer 4. Then utilizing either generally horizontal separation, vertical separation, rate of closure, or any combination of these different factors, the computer 4 uses the data programmed into the computer 4 that indicate at what generally horizontal distances, at what vertical distances, or at what rate of closure the warned aircraft is so close to the warning aircraft that such aircraft constitute "traffic" for one another. When such an even occurs, i.e., when the warning aircraft and the warned aircraft constitute traffic for one another, the computer 4 will activate the warning system 5.

The warning system 5 will preferably first broadcast a tone to alert the pilot of the warned aircraft that such pilot will soon receive an automated air traffic control warning from another aircraft, i.e., the warning aircraft. The warning system 5 will next identify the warned aircraft by vocally stating the four-digit code being transmitted by the transponder aboard the warned aircraft. Using an arbitrary four-digit code for the purpose of illustration and employing the parlance utilized between pilots and air traffic controllers, this identification will state, "Aircraft squawking 3221." Then the warning will vocally provide to the pilot of the warned aircraft the horizontal distance between the warning and the warned aircraft; the altitude of the warning aircraft (if the warning aircraft is equipped with an altitude-measuring device 3) or, optionally if the warned aircraft also has a transponder the altitude of which transponder is included within the information contained in the signal transmitted by that transponder, the vertical distance between the warning aircraft and the warned aircraft; and, preferably, the type of aircraft providing the warning, which type of aircraft would have been programmed into the computer memory circuitry. Thus, using arbitrary figures to provide an example, the complete vocal message would be: "Aircraft squawking 3221, you are ten miles from an unmanned aerial vehicle flying at two thousand feet." Optionally, if the warned aircraft is equipped with a transponder the altitude of which transponder is included within the information contained in the signal transmitted by that transponder, the message could be: "Aircraft squawking 3221, you are ten miles from and one thousand feet above a Beech Baron." Since this warning will be broadcast on a radio frequency which can be received by the automatic direction finder (ADF) aboard the warned aircraft, the pilot of the warned aircraft merely needs to view the indicator for the warned aircraft's ADF to know the last piece of critical air traffic control information, viz., the bearing to the warning aircraft. At the end of the vocal message, the warning system will again preferably broadcast the tone which indicates to the pilot of the warned aircraft that the message was an automated air traffic control warning from another aircraft, i.e., the warning aircraft.

Of course, both the warning aircraft and the warned aircraft must be equipped with appropriate antennae for the radio receivers and transmitters which they are employing.

Unlike at least current ground-based and AWACS technology, the present invention would use low-power transmitters to maximize the probability that only the transponders of relatively nearby aircraft would be interrogated.

And options in addition to those discussed above could render the Collision Avoidance System for Aircraft even more useful.

Since unmanned aerial vehicles are normally operated in an environment containing military aircraft, the code name assigned to each military aircraft expected to be operating within the same area as an unmanned aerial vehicle and the associated four-digit code for the transponder of that aircraft could be programmed into the computer memory circuitry of the unmanned aerial vehicle so that a military pilot under considerable stress would not even have to remember the four-digit code being transmitted by the transponder of the pilot's aircraft. Then, utilizing the relatively colorful terminology customarily employed for such code names, an example of a vocal warning message would be: "Fox Five, you are ten miles from and one thousand feet above an unmanned aerial vehicle."

Figure 2:
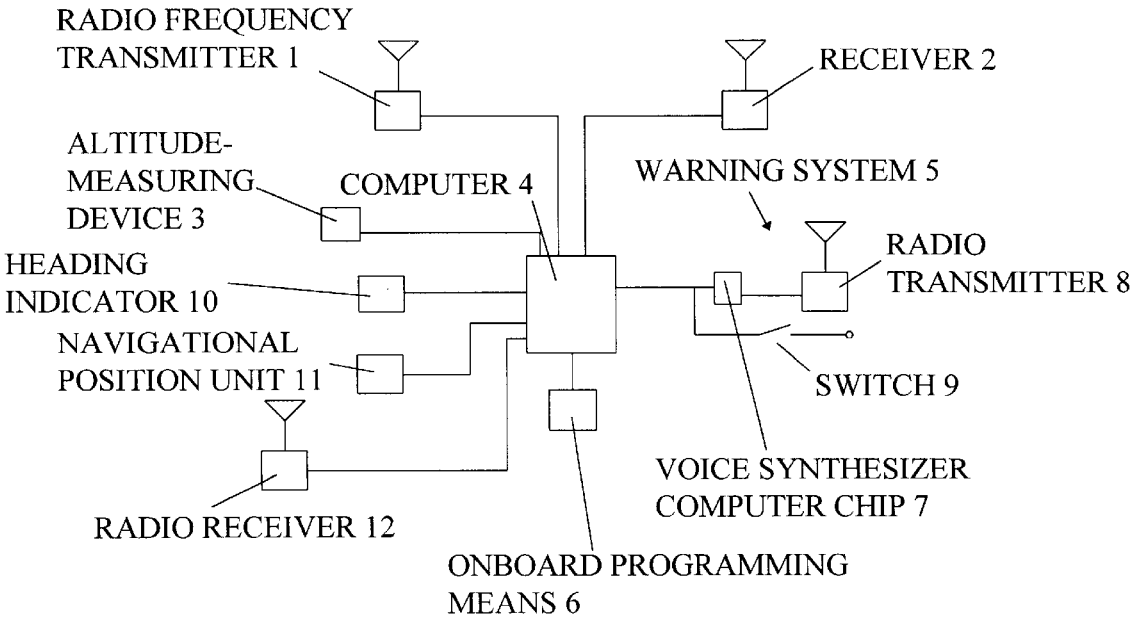
FIG. 2 portrays an optional enhanced embodiment of the Collision Avoidance System.

Additional beneficial information which could be provided in the vocal warning would be the current heading of the warning aircraft. Such heading data could be obtained from any navigational instrument giving heading as an electronic signal, such as 3-axis magnetometer on an unmanned aerial vehicle or a magnetic heading indicator aboard a general aviation or military piloted vehicle; for convenience, such navigational instrument will be termed simply the heading indicator 10. Of course, the heading indicator 10 will communicate with the computer 4, as illustrated in FIG. 2.

An example of the vocal warning message, using the three digits associated with the magnetic heading of the warning aircraft, would then be: "Aircraft squawking 3221, you are ten miles from and one thousand feet above a Beech Baron headed 180."

Even more precise directional information could be provided if the warning aircraft has equipment to determine its position, such as the satellite navigational equipment commonly termed a Global Positioning System (GPS) or - - - when in contact with a ground navigational beacon termed a "VOR" - - - a directional indicator also termed a "VOR" and distance-measuring and indicating equipment called a "DME," because periodic positional measurements provided to the computer 4 would enable the computer 4 to calculate the course (direction the warning aircraft is moving across the ground, which - - - because of wind - - - may differ from the heading of the warning aircraft) of the warning aircraft and to broadcast this data. Then an example of the vocal warning message would be: "Aircraft squawking 3221, you are ten miles from and one thousand feet above a Beech Baron on course 180." For convenience, the navigational equipment determining the position of the warning aircraft will be termed the navigational position unit 11. Again, of course, the navigational position unit 11 communicates, as depicted in FIG. 2, with the computer 4.

Similarly, by obtaining and comparing successive measurements from the altitude-measuring device 3, the computer 4 could determine and the vocal message could indicate the altitudinal trend of the warning aircraft, i.e., whether the warning aircraft is flying level, climbing, or descending. An example of such a vocal warning message would be: "Aircraft squawking 3221, you are ten miles from and one thousand feet above a Beech Baron climbing on course 180."

However, no matter which of the messages the pilot of the warned aircraft receives, such pilot will be able to look for the warning aircraft and to take appropriate evasive action to avoid a collision, whether such pilot actually makes visual contact with the warning aircraft or not. Significantly, the message is the same form as that given by human air traffic controllers throughout the world; and the response by the pilot of the warned aircraft is the same as when such pilot has received a traffic advisory from a human controller.

Because the radio frequencies utilized for air traffic control are often quite busy, the computer 4 of the Collision Avoidance System can, optionally, be programmed to monitor, utilizing an appropriate radio receiver 12 communicating, as shown in FIG. 2, with the computer 4, the frequency on which the radio transmitter 8 will transmit and to await a pause of predetermined length before instructing the warning system 5 to initiate the vocal warning message. Such length could be made dependent on the separation of the warning aircraft and the warned aircraft and/or their rate of closure. Then the closer the two aircraft are, the shorter the pause would be in order to assure that a timely warning would be broadcast.

And appropriate rates for repetition of interrogations of transponders and broadcasting of warnings could be programmed into the computer 4.

Also, the computer 4 could assign priorities to broadcasts if more than one aircraft constitute traffic for the warning aircraft. For example, the first vocal warning could go to the nearest warned aircraft; or the computer could calculate the first potential impact or near miss and broadcast the first warning to the warned aircraft which would be involved in such an incident.

Finally, the Collision Avoidance System could be used to broadcast a warning other than one indicating that two aircraft constitute "traffic" for one another. For example, the system could be installed in an area where airspace has been closed to unauthorized aircraft and broadcast a vocal warning message to any aircraft approaching such an area.

One word of practical caution should, however, be given. In the military setting (where unmanned aerial vehicles would likely be the warning aircraft and manned fighters and bombers would constitute the warned aircraft) the vocal air traffic control message would be broadcast on ultra high frequencies (UHF) which the automatic direction finders (ADF's) of military aircraft are built to receive. And the pilots of the manned fighters and bombers would be told, before a particular mission, which frequencies to monitor. The automatic direction finders (ADF's) in general aviation aircraft operate on the broadcast frequencies associated with standard commercial a m (audio modulation) radio broadcast stations, and general aviation aircraft do not currently have radios which transmit at these frequencies. Thus, to have the present system work fully, general aviation aircraft would either (a) have to be equipped with ADF's which work at other frequencies or (b) have to be provided with, and be given permission from the Federal Communications Commission to use, radios which transmit on the broadcast frequencies associated with standard commercial am radio broadcasts.

(Of course, the radio transmitter 8 could simultaneously broadcast both on UHF and standard a m broadcast frequencies.)

Even without the ADF feature, however, the aircraft warned by the present Collision Avoidance System would know the range of a nearby aircraft and, if that aircraft were equipped with a transponder the altitude of which transponder is included within the information contained in the signal transmitted by that transponder, the altitude of such other aircraft.

Although attention has been directed toward providing a warning to other aircraft, the computer 4 of the Collision Avoidance System could, also, have a warning sent to the warning aircraft, itself. This could be a voice message or an electronic signal which could be sent an automated control system so that the warning aircraft would act to avoid a collision.

I claim:

1. A collision avoidance system for a warning aircraft, which comprises:

an interrogate transmitter which sends a signal to interrogated the transponder of warned aircraft;

an interrogating receiver to receive the signal which has been transmitted by the transponder of warned aircraft;

a computer having memory circuitry into which can be programmed the type of aircraft that the warning aircraft is and the generally horizontal distance or the rate of closure at which the warning aircraft and the warned aircraft will be so close or approaching one another so rapidly as to constitute traffic for one another and also having logic circuitry for determining time differentials, for calculating the generally horizontal distance between the warning aircraft and the warned aircraft by using the difference in time between the sending of the interrogation by the warning aircraft and the receipt of the answering data from the transponder of the warned aircraft, and for utilizing the data in the computer memory together with the preceding calculations to determine whether the warning aircraft and the warned aircraft constitute "traffic" for one another, which computer communicates with said interrogating transmitter and with said interrogating receiver; and a warning system which communicates with said computer and provides a vocal warning to the warned aircraft, at the direction of the computer when said computer determines that the warning aircraft and the warned aircraft constitute traffic for one another.

2. The collision avoidance system for a warning aircraft as recited in claim 1, wherein:

said computer is adapted to be connected to a radio receiver capable of receiving the frequency on which the warning system will transmit;

said computer has been programmed to await a pause of predetermined length before instructing the warning system to initiate the vocal warning message; and said computer has been programmed with rates for the repetition of interrogations of transponders and broadcasting of warnings.

3. The collision avoidance system for a warning aircraft as recited in claim 2, wherein:

said computer has been programmed to assign priorities to broadcasts if more than one aircraft constitute traffic for the warning aircraft.

4. The collision avoidance system for a warning aircraft as recited in claim 1, wherein:

said computer has been programmed to assign priorities to broadcasts if more than one aircraft constitute traffic for the warning aircraft.

5. The collision avoidance system for a warning aircraft as recited in claim 1, wherein:

said computer is adapted to communicate with a heading indicator in the warning aircraft and to use the information from said heading indicator to direct the warning system to include the heading of the warning aircraft in the vocal warning said warning system broadcasts.

6. The collision avoidance system for a warning aircraft as recited in claim 5, wherein:

said computer is adapted to be connected to a radio receiver capable of receiving the frequency on which the warning system will transmit;

said computer has been programmed to await a pause of predetermined length before instructing the warning system to initiate the vocal warning message; and said computer has been programmed with rates for the repetition of interrogations of transponders and broadcasting of warnings.

7. The collision avoidance system for a warning aircraft as recited in claim 6, wherein:

said computer has been programmed to assign priorities to broadcasts if more than one aircraft constitute traffic for the warning aircraft.

8. The collision avoidance system for a warning aircraft as recited in claim 5, wherein:

said computer has been programmed to assign priorities to broadcasts if more than one aircraft constitute traffic for the warning aircraft.

9. The collision avoidance system for a warning aircraft as recited in claim 1, wherein:

said computer is adapted to communicate with a navigational position unit in the warning aircraft and to use the information from said navigational position unit to calculate the course of the warning aircraft and to direct the warning system to include the course of the warning aircraft in the vocal warning said warning system broadcasts.

10. The collision avoidance system for a warning aircraft as recited in claim 9, wherein:

said computer is adapted to be connected to a radio receiver capable of receiving the frequency on which the warning system will transmit;

said computer has been programmed to await a pause of predetermined length before instructing the warning system to initiate the vocal warning message; and said computer has been programmed with rates for the repetition of interrogations of transponders and broadcasting of warnings.

11. The collision avoidance system for a warning aircraft as recited in claim 10, wherein:

said computer has been programmed to assign priorities to broadcasts if more than one aircraft constitute traffic for the warning aircraft.

12. The collision avoidance system for a warning aircraft as recited in claim 9, wherein:

said computer has been programmed to assign priorities to broadcasts if more than one aircraft constitute traffic for the warning aircraft.

13. The collision avoidance system for a warning aircraft as recited in claim 1, wherein:

said computer is adapted to communicate with an altitude-measuring device in the warning aircraft and to use the information from said altitude-measuring device to direct the warning system to include the altitude of the warning aircraft in the vocal warning said warning system broadcasts.

14. The collision avoidance system for a warning aircraft as recited in claim 13, wherein:

said computer is adapted to be connected to a radio receiver capable of receiving the frequency on which the warning system will transmit;

said computer has been programmed to await a pause of predetermined length before instructing the warning system to initiate the vocal warning message; and said computer has been programmed with rates for the repetition of interrogations of transponders and broadcasting of warnings.

15. The collision avoidance system for a warning aircraft as recited in claim 14, wherein:

said computer has been programmed to assign priorities to broadcasts if more than one aircraft constitute traffic for the warning aircraft.

16. The collision avoidance system for a warning aircraft as recited in claim 13, wherein:

said computer has been programmed to assign priorities to broadcasts if more than one aircraft constitute traffic for the warning aircraft.

17. The collision avoidance system for a warning aircraft as recited in claim 13, wherein:

said computer is adapted to communicate with a heading indicator in the warning aircraft and to use the information from said heading indicator to direct the warning system to include the heading of the warning aircraft in the vocal warning said warning system broadcasts.

18. The collision avoidance system for a warning aircraft as recited in claim 17, wherein:

said computer is adapted to be connected to a radio receiver capable of receiving the frequency on which the warning system will transmit;

said computer has been programmed to await a pause of predetermined length before instructing the warning system to initiate the vocal warning message; and said computer has been programmed with rates for the repetition of interrogations of transponders and broadcasting of warnings.

19. The collision avoidance system for a warning aircraft as recited in claim 18, wherein:

said computer has been programmed to assign priorities to broadcasts if more than one aircraft constitute traffic for the warning aircraft.

20. The collision avoidance system for a warning aircraft as recited in claim 17, wherein:

said computer has been programmed to assign priorities to broadcasts if more than one aircraft constitute traffic for the warning aircraft.

21. The collision avoidance system for a warning aircraft as recited in claim 13, wherein:

said computer is adapted to communicate with a navigational position unit in the warning aircraft and to use the information from said navigational position unit to calculate the course of the warning aircraft and to direct the warning system to include the course of the warning aircraft in the vocal warning said warning system broadcasts.

22. The collision avoidance system for a warning aircraft as recited in claim 21, wherein:

said computer is adapted to be connected to a radio receiver capable of receiving the frequency on which the warning system will transmit;

said computer has been programmed to await a pause of predetermined length before instructing the warning system to initiate the vocal warning message; and said computer has been programmed with rates for the repetition of interrogations of transponders and broadcasting of warnings.

23. The collision avoidance system for a warning aircraft as recited in claim 22, wherein:

said computer has been programmed to assign priorities to broadcasts if more than one aircraft constitute traffic for the warning aircraft.

24. The collision avoidance system for a warning aircraft as recited in claim 21, wherein:

said computer has been programmed to assign priorities to broadcasts if more than one aircraft constitute traffic for the warning aircraft.

25. The collision avoidance system for a warning aircraft as recited in claim 13, wherein:

said computer has been programmed to calculate the vertical distance between the warned aircraft and the warning aircraft for any warned aircraft that provides a signal from a transponder the altitude of which transponder is included within the information contained in the signal transmitted by that transponder, and to direct the warning system to include the vertical distance between the warning aircraft and the warned aircraft in the vocal warning said warning system broadcasts for any warned aircraft that provides a signal from a transponder the altitude of which transponder is included within the information contained in the signal transmitted by that transponder.

26. The collision avoidance system for a warning aircraft as recited in claim 25, wherein:

said computer is adapted to be connected to a radio receiver capable of receiving the frequency on which the warning system will transmit;

said computer has been programmed to await a pause of predetermined length before instructing the warning system to initiate the vocal warning message; and said computer has been programmed with rates for the repetition of interrogations of transponders and broadcasting of warnings.

27. The collision avoidance system for a warning aircraft as recited in claim 26, wherein:

said computer has been programmed to assign priorities to broadcasts if more than one aircraft constitute traffic for the warning aircraft.

28. The collision avoidance system for a warning aircraft as recited in claim 25, wherein:

said computer has been programmed to assign priorities to broadcasts if more than one aircraft constitute traffic for the warning aircraft.

29. The collision avoidance system for a warning aircraft as recited in claim 25, wherein:

said computer is adapted to communicate with a heading indicator in the warning aircraft and to use the information from said heading indicator to direct the warning system to include the heading of the warning aircraft in the vocal warning said warning system broadcasts.

30. The collision avoidance system for a warning aircraft as recited in claim 29, wherein:

said computer is adapted to be connected to a radio receiver capable of receiving the frequency on which the warning system will transmit;

said computer has been programmed to await a pause of predetermined length before instructing the warning system to initiate the vocal warning message; and said computer has been programmed with rates for the repetition of interrogations of transponders and broadcasting of warnings.

31. The collision avoidance system for a warning aircraft as recited in claim 30, wherein:

said computer has been programmed to assign priorities to broadcasts if more than one aircraft constitute traffic for the warning aircraft.

32. The collision avoidance system for a warning aircraft as recited in claim 29, wherein:

said computer has been programmed to assign priorities to broadcasts if more than one aircraft constitute traffic for the warning aircraft.

33. The collision avoidance system for a warning aircraft as recited in claim 25, wherein:

said computer is adapted to communicate with a navigational position unit in the warning aircraft and to use the information from said navigational position unit to calculate the course of the warning aircraft and to direct the warning system to include the course of the warning aircraft in the vocal warning said warning system broadcasts.

34. The collision avoidance system for a warning aircraft as recited in claim 33, wherein:

said computer is adapted to be connected to a radio receiver capable of receiving the frequency on which the warning system will transmit;

said computer has been programmed to await a pause of predetermined length before instructing the warning system to initiate the vocal warning message; and said computer has been programmed with rates for the repetition of interrogations of transponders and broadcasting of warnings.

35. The collision avoidance system for a warning aircraft as recited in claim 34, wherein:

said computer has been programmed to assign priorities to broadcasts if more than one aircraft constitute traffic for the warning aircraft.

36. The collision avoidance system for a warning aircraft as recited in claim 33, wherein:

said computer has been programmed to assign priorities to broadcasts if more than one aircraft constitute traffic for the warning aircraft.

37. The collision avoidance system for a warning aircraft as recited in claim 25, wherein:

said computer has been programmed to obtain and compare successive measurements from the altitude-measuring device in order to determine the altitudinal trend of the warning aircraft, and to direct the warning system to include the altitudinal trend of the warning aircraft in the vocal warning said warning system broadcasts.

38. The collision avoidance system for a warning aircraft as recited in claim 37, wherein:

said computer is adapted to be connected to a radio receiver capable of receiving the frequency on which the warning system will transmit;

said computer has been programmed to await a pause of predetermined length before instructing the warning system to initiate the vocal warning message; and said computer has been programmed with rates for the repetition of interrogations of transponders and broadcasting of warnings.

39. The collision avoidance system for a warning aircraft as recited in claim 38, wherein:

said computer has been programmed to assign priorities to broadcasts if more than one aircraft constitute traffic for the warning aircraft.

40. The collision avoidance system for a warning aircraft as recited in claim 37, wherein:

said computer has been programmed to assign priorities to broadcasts if more than one aircraft constitute traffic for the warning aircraft.

41. The collision avoidance system for a warning aircraft as recited in claim 37, wherein:

said computer is adapted to communicate with a heading indicator in the warning aircraft and to use the information from said heading indicator to direct the warning system to include the heading of the warning aircraft in the vocal warning said warning system broadcasts.

42. The collision avoidance system for a warning aircraft as recited in claim 41, wherein:

said computer is adapted to be connected to a radio receiver capable of receiving the frequency on which the warning system will transmit;

said computer has been programmed to await a pause of predetermined length before instructing the warning system to initiate the vocal warning message; and said computer has been programmed with rates for the repetition of interrogations of transponders and broadcasting of warnings.

43. The collision avoidance system for a warning aircraft as recited in claim 42, wherein:

said computer has been programmed to assign priorities to broadcasts if more than one aircraft constitute traffic for the warning aircraft.

44. The collision avoidance system for a warning aircraft as recited in claim 41, wherein:

said computer has been programmed to assign priorities to broadcasts if more than one aircraft constitute traffic for the warning aircraft.

45. The collision avoidance system for a warning aircraft as recited in claim 37, wherein:

said computer is adapted to communicate with a navigational position unit in the warning aircraft and to use the information from said navigational position unit to calculate the course of the warning aircraft and to direct the warning system to include the course of the warning aircraft in the vocal warning said warning system broadcasts.

46. The collision avoidance system for a warning aircraft as recited in claim 45, wherein:

said computer is adapted to be connected to a radio receiver capable of receiving the frequency on which the warning system will transmit;

said computer has been programmed to await a pause of predetermined length before instructing the warning system to initiate the vocal warning message; and said computer has been programmed with rates for the repetition of interrogations of transponders and broadcasting of warnings.

47. The collision avoidance system for a warning aircraft as recited in claim 46, wherein:

said computer has been programmed to assign priorities to broadcasts if more than one aircraft constitute traffic for the warning aircraft.

48. The collision avoidance system for a warning aircraft as recited in claim 45, wherein:

said computer has been programmed to assign priorities to broadcasts if more than one aircraft constitute traffic for the warning aircraft.

49. The collision avoidance system for a warning aircraft as recited in claim 13, wherein:

said computer has been programmed to obtain and compare successive measurements from the altitude-measuring device in order to determine the altitudinal trend of the warning aircraft, and to direct the warning system to include the altitudinal trend of the warning aircraft in the vocal warning said warning system broadcasts.

50. The collision avoidance system for a warning aircraft as recited in claim, 49, wherein:

said computer is adapted to communicate with a radio receiver capable of receiving the frequency on which the warning system will transmit;

said computer has been programmed to await a pause of predetermined length before instructing the warning system to initiate the vocal warning message; and said computer has been programmed with rates for the repetition of interrogations of transponders and broadcasting of warnings.

51. The collision avoidance system for a warning aircraft as recited in claim 50, wherein:

said computer has been programmed to assign priorities to broadcasts if more than one aircraft constitute traffic for the warning aircraft.

52. The collision avoidance system for a warning aircraft as recited in claim 49, wherein:

said computer has been programmed to assign priorities to broadcasts if more than one aircraft constitute traffic for the warning aircraft.

53. The collision avoidance system for a warning aircraft as recited in claim 49, wherein:

said computer is adapted to communicate with a heading indicator in the warning aircraft and to use the information from said heading indicator to direct the warning system to include the heading of the warning aircraft in the vocal warning said warning system broadcasts.

54. The collision avoidance system for a warning aircraft as recited in claim 53, wherein:

said computer is adapted to be connected to a radio receiver capable of receiving the frequency on which the warning system will transmit;

said computer has been programmed to await a pause of predetermined length before instructing the warning system to initiate the vocal warning message; and said computer has been programmed with rates for the repetition of interrogations of transponders and broadcasting of warnings.

55. The collision avoidance system for a warning aircraft as recited in claim 54, wherein:

said computer has been programmed to assign priorities to broadcasts if more than one aircraft constitute traffic for the warning aircraft.

56. The collision avoidance system for a warning aircraft as recited in claim 53, wherein:

said computer has been programmed to assign priorities to broadcasts if more than one aircraft constitute traffic for the warning aircraft.

57. The collision avoidance system for a warning aircraft as recited in claim 49, wherein:

said computer is adapted to communicate with a navigational position unit in the warning aircraft and to use the information from said navigational position unit to calculate the course of the warning aircraft and to direct the warning system to include the course of the warning aircraft in the vocal warning said warning system broadcasts.

58. The collision avoidance system for a warning aircraft as recited in claim 57, wherein:

said computer is adapted to be connected to a radio receiver capable of receiving the frequency on which the warning system will transmit;

said computer has been programmed to await a pause of predetermined length before instructing the warning system to initiate the vocal warning message; and said computer has been programmed with rates for the repetition of interrogations of transponders and broadcasting of warnings.

59. The collision avoidance system for a warning aircraft as recited in claim 58, wherein:

said computer has been programmed to assign priorities to broadcasts if more than one aircraft constitute traffic for the warning aircraft.

60. The collision avoidance system for a warning aircraft as recited in claim 57, wherein:

said computer has been programmed to assign priorities to broadcasts if more than one aircraft constitute traffic for the warning aircraft.

61. A collision avoidance system for a warning aircraft, which comprises:

a means for interrogating the transponder of warned aircraft;

a means for receiving the signal which has been transmitted by the transponder of warned aircraft;

a means for storing the type of aircraft that the warning aircraft is and the generally horizontal distance or the rate of closure at which the warning aircraft and the warned aircraft will be so close or approaching one another so rapidly as to constitute traffic for one and another and also for determining time differentials, for calculating the generally horizontal distance between the warning aircraft and the warned aircraft by using the difference in time between the sending of the interrogation by the warning aircraft and the receipt of the answering data from the transponder of the warned aircraft, and for utilizing the data in the computer memory together with the preceding calculations to determine whether the warning aircraft and the warned aircraft constitute "traffic" for one another, which means for storing and determining communicates with the means for interrogating and the means for receiving; and a means for providing a vocal warning to the warned aircraft, at the direction of the means for storing and determining when said means for storing and determining determines that the warning aircraft and the warned aircraft constitute traffic for one another.

62. A process for avoiding collision between aircraft, which comprises:

interrogating the transponder of warned aircraft;

receiving the signal which has been transmitted by the transponder of warned aircraft;

storing the generally generally horizontal distance or the rate of closure at which the warning aircraft and the warned aircraft will be so close or approaching one another so rapidly as to constitute traffic for one and another;

calculating the generally horizontal distance between the warning aircraft and the warned aircraft by using the difference in time between the sending of the interrogation by the warning aircraft and the receipt of the answering data from the transponder of the warned aircraft;

utilizing the stored data together with the preceding calculations to determine whether the warning aircraft and the warned aircraft constitute "traffic" for one another; and providing a vocal warning to the warned aircraft when the warning aircraft and the warned aircraft constitute traffic for one another.

* * * * *